US007052314B1

(12) United States Patent
Rose

(10) Patent No.: US 7,052,314 B1
(45) Date of Patent: May 30, 2006

(54) ELECTRICAL DEVICE WITH MOUNTING SYSTEM

(75) Inventor: Elmer Algin Rose, Salem, OR (US)

(73) Assignee: Intumescent Technologies, LLC, Atlanta, GA (US)

( * ) Notice: Subject to any disclaimer, the term of this patent is extended or adjusted under 35 U.S.C. 154(b) by 0 days.

(21) Appl. No.: 10/700,822

(22) Filed: Nov. 4, 2003

Related U.S. Application Data

(60) Provisional application No. 60/423,419, filed on Nov. 4, 2002, provisional application No. 60/460,730, filed on Apr. 7, 2003.

(51) Int. Cl.
*H01R 13/60* (2006.01)

(52) U.S. Cl. ..... 439/539; 174/53

(58) Field of Classification Search ..... 439/535, 439/538, 539; 174/53, 51, 54, 57, 58; 220/3.2–3.9
See application file for complete search history.

(56) References Cited

U.S. PATENT DOCUMENTS

| | | | | | |
|---|---|---|---|---|---|
| 2,455,889 | A | * | 12/1948 | Despard | 174/53 |
| 2,966,654 | A | * | 12/1960 | Hubbell et al. | 439/538 |
| 3,403,215 | A | * | 9/1968 | Slater et al. | 174/53 |
| 3,689,864 | A | * | 9/1972 | Glader | 439/97 |
| 5,389,011 | A | * | 2/1995 | Eder | 439/577 |

* cited by examiner

*Primary Examiner*—Ross Gushi
(74) *Attorney, Agent, or Firm*—Biddle & Associates, P.C.

(57) ABSTRACT

An electrical device wherein a mounting yoke is provided for mounting the electrical device in an outlet box. The mounting yoke includes a channel for receiving a mounting screw having a support rim and allowing it to be passed into a mounting hole.

16 Claims, 13 Drawing Sheets

ELECTRICAL DEVICE WITH MOUNTING SYSTEM

CLAIM OF PRIORITY

This application claims priority to co-pending U.S. provisional patent application(s) entitled, "DEVICE SUPPORT SCREW AND YOKE," having Ser. No. 60/423,419 filed on Nov. 4, 2002 and U.S. provisional patent application entitled "SUPPORT SCREW, TOOL AND YOKE ASSEMBLY" having Ser. No. 60/460,730 filed on Apr. 7, 2003, the disclosures of which are each incorporated herein in there entirety by reference.

TECHNICAL FIELD

The present invention is generally related to electrical devices. More particularly, the present invention is related to a wall mounted electrical device with provisions for support at a predetermined position.

BACKGROUND OF THE INVENTION

The typical house or building is equipped with multiple surface mounted electrical receptacles and/or switches for distribution and/or on/off control of electricity within the house/building. With reference to FIG. 1A, these receptacles and switches are generally mounted in an outlet box 75 that is attached to the frame structure 67 of a wall, floor or ceiling structure 60 and behind the wall or floor surface covering 80. FIG. 1B is a diagram illustrating a properly mounted electrical receptacle 100, installed into an outlet box 75 that is attached to a support structure 67 (FIG. 1A) and located behind/beneath a wall covering 80. With reference to FIG. 1A and FIG. 1B, it can be seen that the electrical device 100 is configured as an electrical switch 102 and includes a yoke 110 that is in contact with and supported by wall covering 80 at points 95. The yoke 110 is secured to the outlet box 75 via one or more screws 90. The yoke 110 may also be referred to as "strap" 110. A faceplate 55 can then be mounted over the receptacle 110 so that the faceplate 55 is held against the wall surface 80.

During construction, the task of installing each outlet box 75 is carried out at a point in time after construction of the wall structure framing 67 but before installation of the wall covering 80. When the wall covering 80 is installed, holes must be cut in the covering 80 to accommodate the outlet box 75 attached to the frame structure 67 and thereby make it accessible from outside. Unless the holes are cut in the covering 80, the outlet box 75 will be inaccessible for installation of the device 100 (i.e. the outlet box will be located behind the wall covering). Unfortunately, it is common for holes to be cut into wall/flooring covering 80 with less precision than is desirable. The result is often holes within the wall/flooring covering 80 that are larger than they need to be in order to accommodate the outlet box 75. As typical electrical receptacles/switches 100 are designed to be mounted in an outlet box 75 via screws 90 and held against the surface edge of the wall covering 80 around the cut hole, it is important that the wall covering 80 be cut no larger than necessary to accommodate the outlet box 75. Where the wall covering 80 is cut too large, the surface of the wall surface 80 will be too far from the outlet box 75 to provide support for the electrical receptacle/switch. The result is that the receptacle/switch 100 is not provided any support and is held in place at a level with the wall surface by the face plate that is installed over the receptacle/switch. The receptacle/switch may be securely held in place by the faceplate, at least temporarily for a period of time. Eventually the pressure/forces of ordinary use combined with the lack of true support of the receptacle/switch by anything other than the faceplate 55, stresses the faceplate 55 to a point where it breaks and is unable to provide support to the receptacle/switch. This results in the receptacle/switch becoming loose and pushed backward into the outlet box where it can not be easily accessed. This increases the risk of shock and fire. Further, it is a condition which fails to meet the criteria specified by most fire, building and/or building safety codes.

FIG. 1C is a diagram illustrating an improperly mounted electrical device 100, installed into an outlet box 75 that is attached to a support structure (not shown) and located behind/beneath a wall covering 80. In this illustration it can be seen that the yoke 110 is not in contact with or supported by the wall covering 80 at points 96. Thus, the yoke 110 is not secured to the outlet box 75 via screws 90. In this situation a faceplate 55 may be mounted to the electrical device 100, however the faceplate 55 will typically be the only thing holding the electrical device 100 in the proper position.

FIG. 1D is a diagram showing a representation of a typical wall mounted electrical device 100 that is configured as a switch 102. FIG. 1E and FIG. 1F are diagrams showing a representation of an electrical device 100 that is configured as a typical wall mountable electrical receptacle 103. With reference to FIG. 1D–FIG. 1F, device 100 includes a yoke 110, and slotted mounting holes 115 for receiving a mounting screw 90 (FIG. 1B). The electrical receptacle 100 can be mounted into an outlet box 75 (FIG. 1A) via the mounting screws 90.

FIG. 1G and FIG. 1H are diagrams illustrating an embodiment of a typical screw 90 that is used to secure an electrical receptacle 100 into an outlet box 75 (FIG. 1A and FIG. 1B). The screw 90 may have a head 91 that is attached at one end of an elongated post 93. The elongated post 93 is typically threaded in a manner that will allow it to be received into a threaded portion of the outlet box 75.

Thus, a heretofore unaddressed need exists in the industry to address the aforementioned deficiencies and inadequacies.

SUMMARY OF THE INVENTION

The present invention provides an electrical device having a mounting system. Briefly described, in architecture, the system can be implemented as follows. An electrical device is provided that includes a mounting yoke for mounting the electrical device into an outlet box.

Other features and advantages of the present invention will become apparent to one with skill in the art upon examination of the following drawings and detailed description. It is intended that all such additional features and advantages be included herein within the scope of the present invention.

BRIEF DESCRIPTION OF THE DRAWINGS

The invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

The present invention is directed an electrical device that is wall mountable in a standard outlet box. The electrical device may be configured as an electrical receptacle, switch, dimmer, dimmer/switch and/or audio or video control. Electrical receptacles may include, for example, receptacles for distribution of household current, cable television, satellite television, audio speaker distribution jacks, telephone jacks, as well as any other type of device that is designed to be mounted into an outlet box. The invention is configured to provide for the secure positioning of the electrical device at a desired level in relation to an electrical outlet box and without the support of an adjacent surface, such as a wall or flooring surface.

Figure 1A:
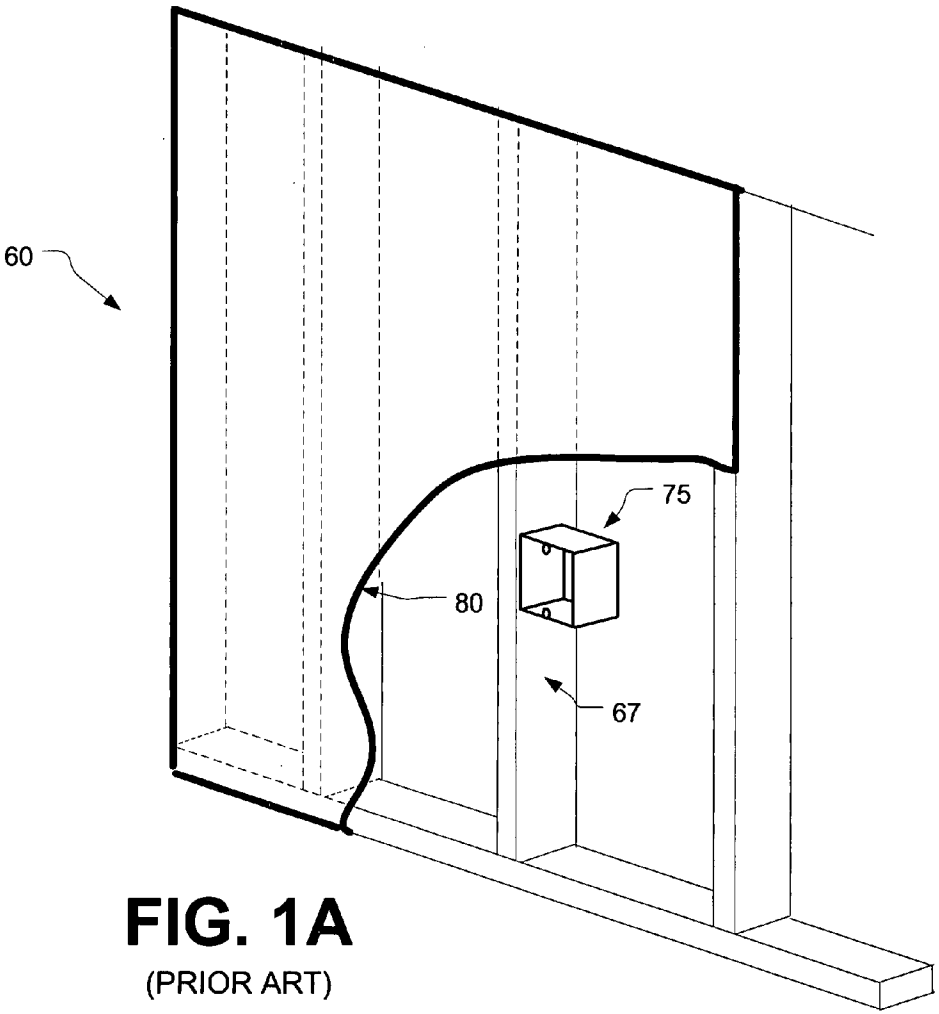
FIG. 1A (PRIOR ART)
FIG. 1A is a diagram showing a representation of a wall structure 67 and an outlet box 75 attached to the wall structure.
Figure 1B:
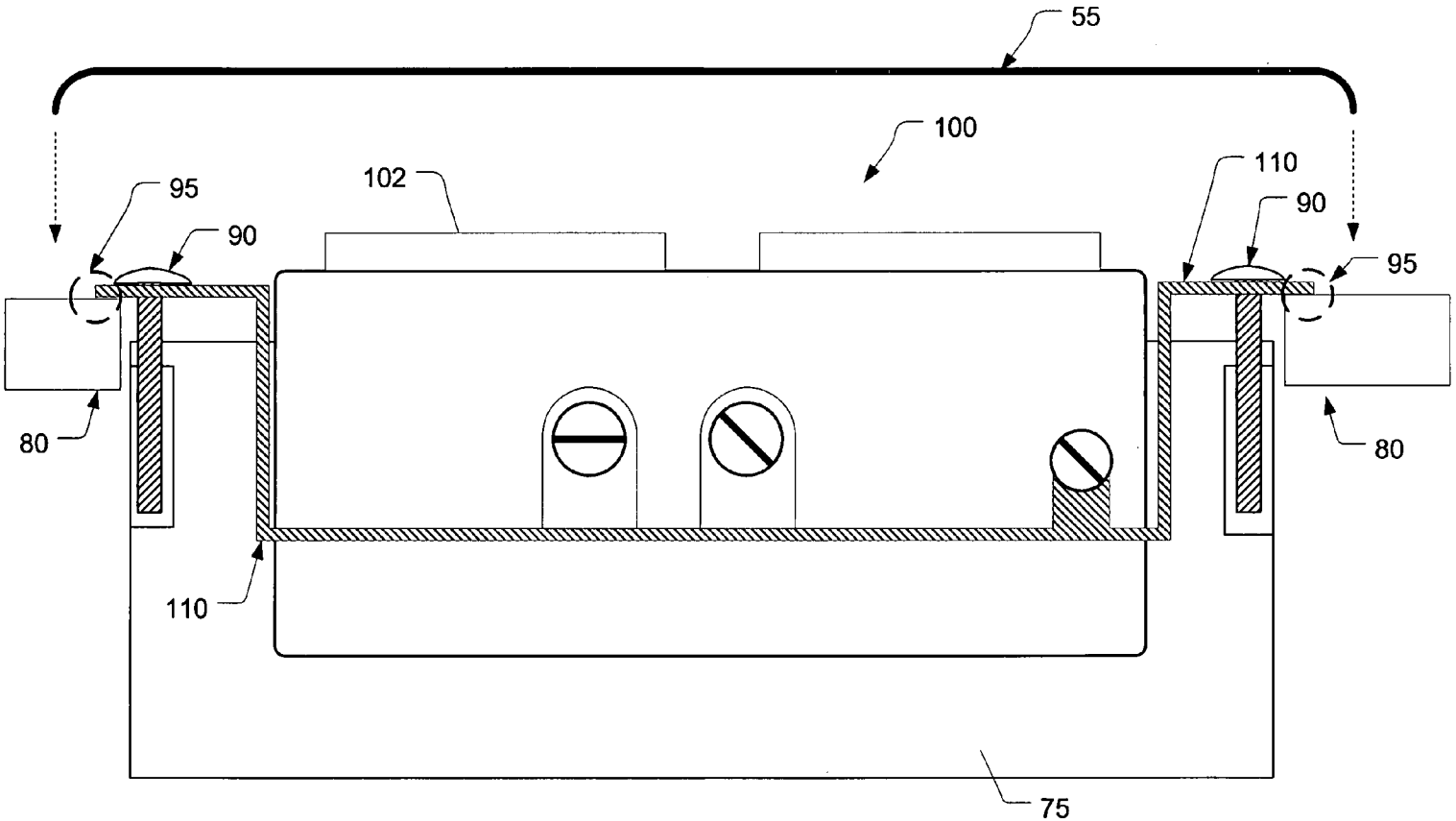
FIG. 1B (PRIOR ART)
FIG. 1B is a diagram illustrating a properly mounted electrical receptacle 100.
Figure 1C:
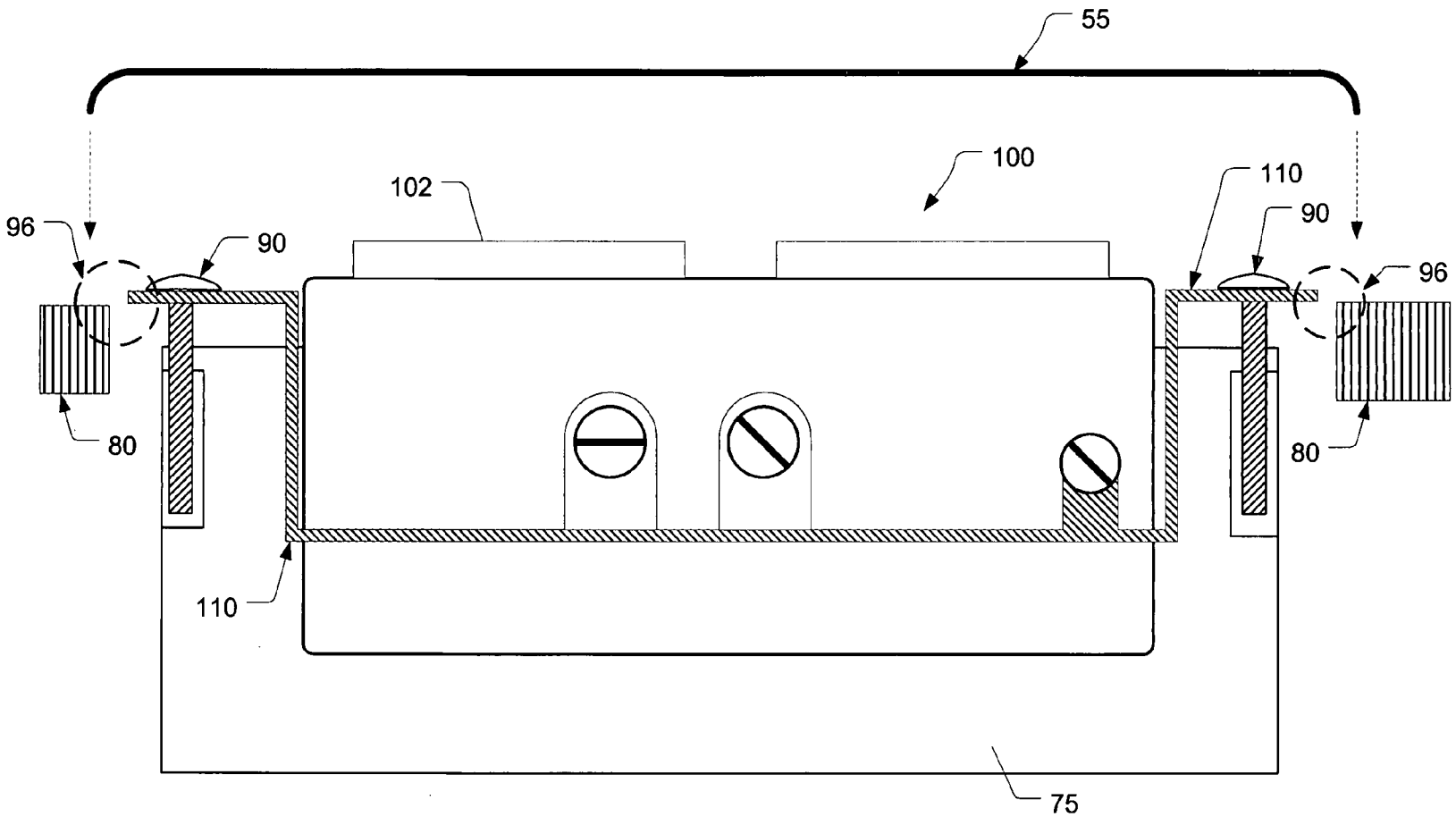
FIG. 1C (PRIOR ART)
FIG. 1C is a diagram showing a representation of an improperly mounted electrical receptacle 100.
Figure 1F:
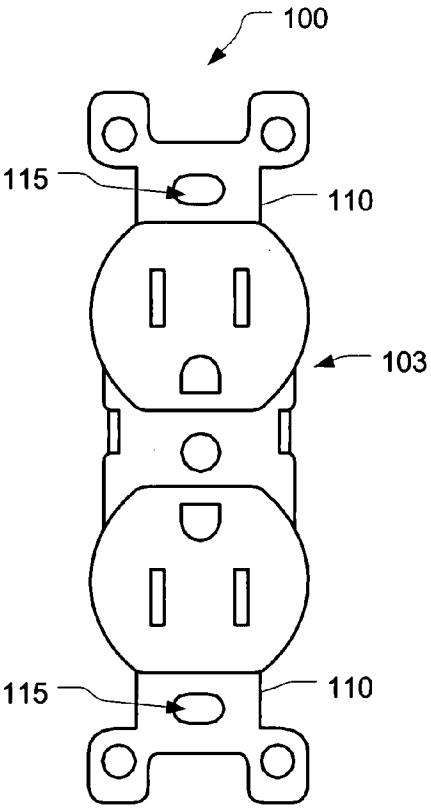
FIG. 1F (PRIOR ART)
FIG. 1D–FIG. 1F are block diagrams illustrating a representation of typical electrical receptacles 100.
Figure 1E:
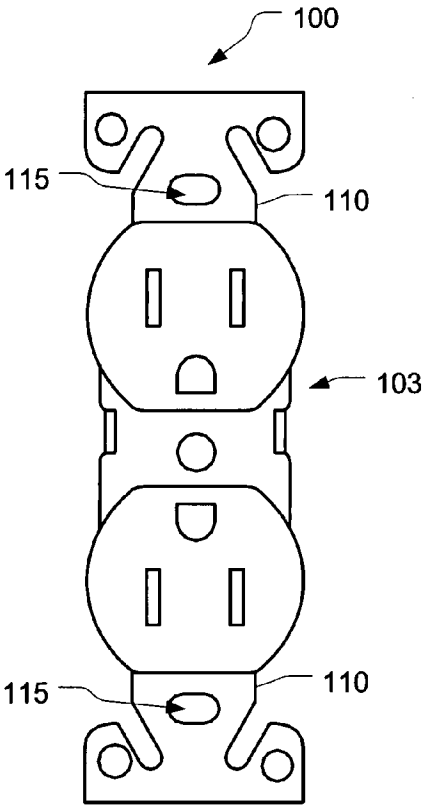
FIG. 1E (PRIOR ART)
Figure 1D:
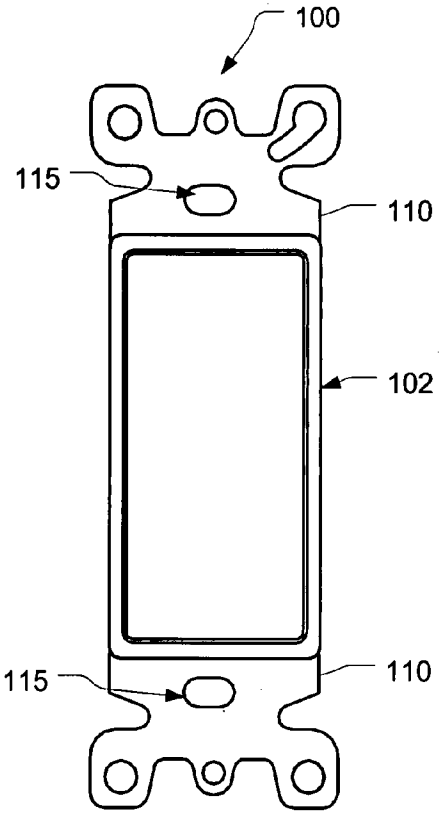
FIG. 1D (PRIOR ART)
Figure 1H:
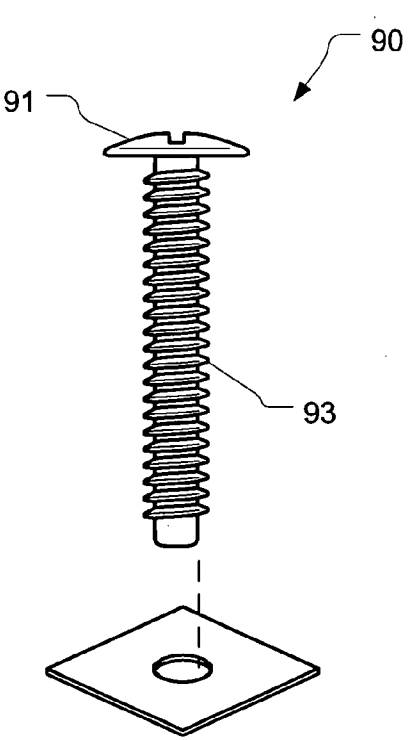
FIG. 1H (PRIOR ART)
FIG. 1G and FIG. 1H are diagrams illustrating an electrical device 100 that is not supported by adjacent wall surface 80.
Figure 1G:
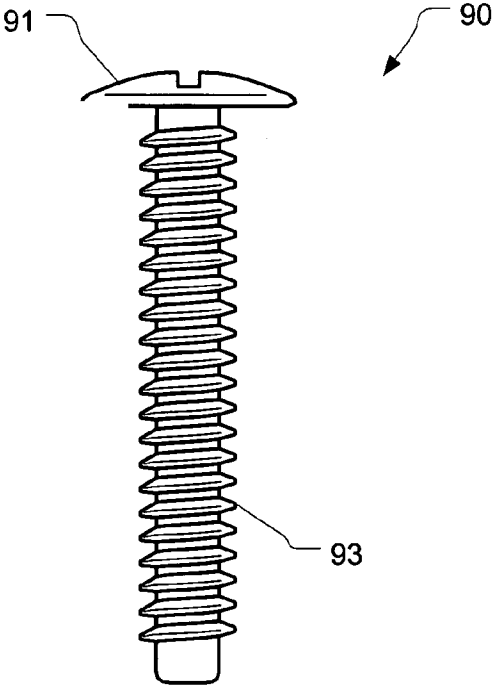
FIG. 1G (PRIOR ART)
Figure 2A:
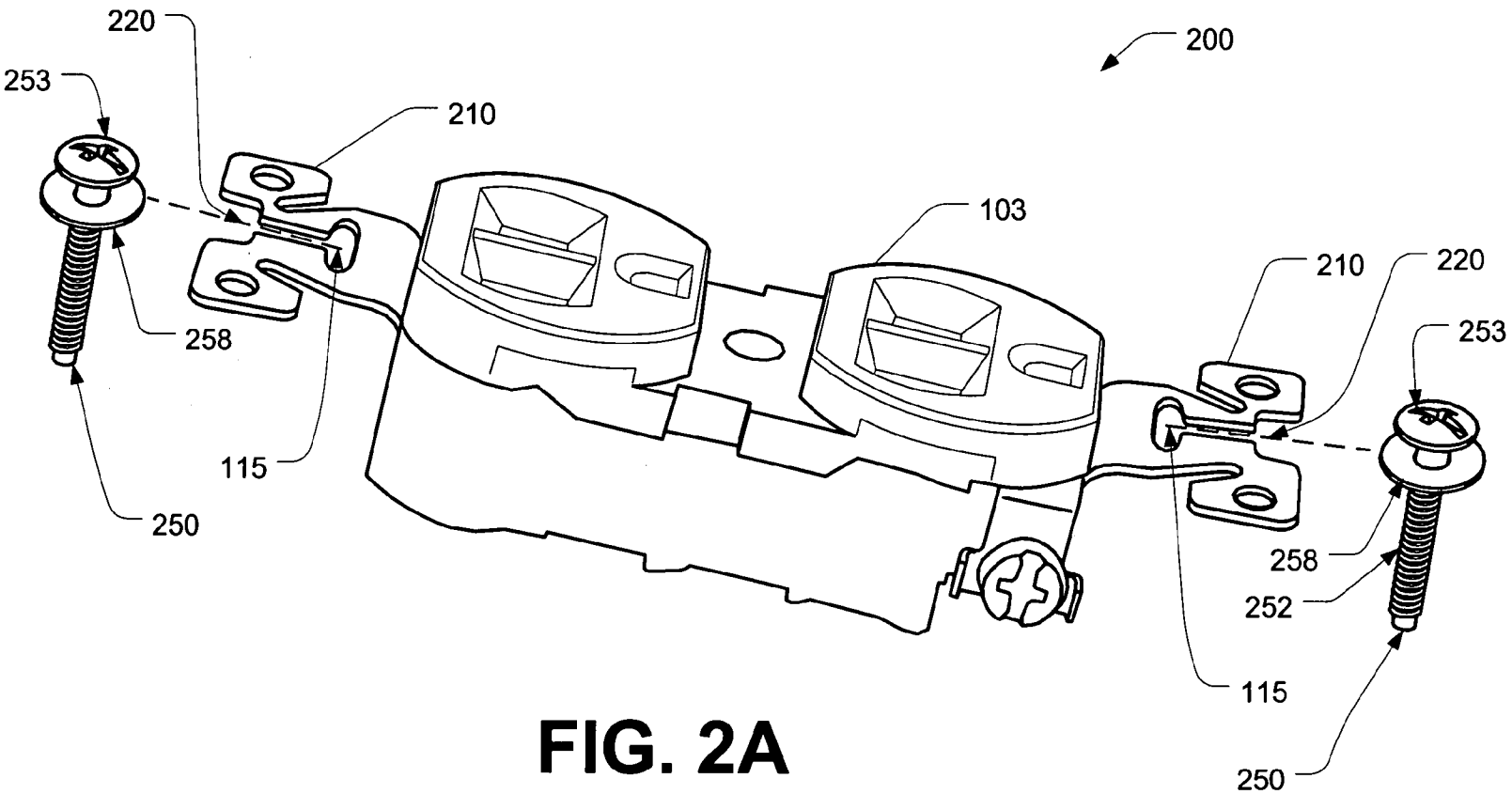
FIG. 2A is a diagram illustrating an embodiment of an electrical device 210 according to the invention.

FIG. 2A is a diagram illustrating an embodiment of an electrical device 200 according to the invention. In this embodiment, an electrical device 200 is provided that is configured as an electrical receptacle 103 that includes a mounting yoke 210. The mounting yoke 210 is configured to include slotted mounting holes 115. The slotted mounting holes 115 are configured to receive and accommodate mounting screw 250. The mounting screw 250 is configured to include an elongated post 252 having a predetermined diameter and length. A head 253 is attached at one end of the elongated post 252. A support rim 258 is positioned along the elongate post 252. The support rim 258 in conjunction with the head 253 is configured to securely hold the yoke 210 there between when the mounting screw 250 is placed into the slotted mounting hole 115.

Channels 220 are provided adjacent to each of the slotted mounting holes 115. The channels 220 are configured to receive mounting screw 250 and to allow the elongated post 252 of mounting screw 250 to pass into the slotted mounting hole 115.

Figures 2B, 2C, 2D:
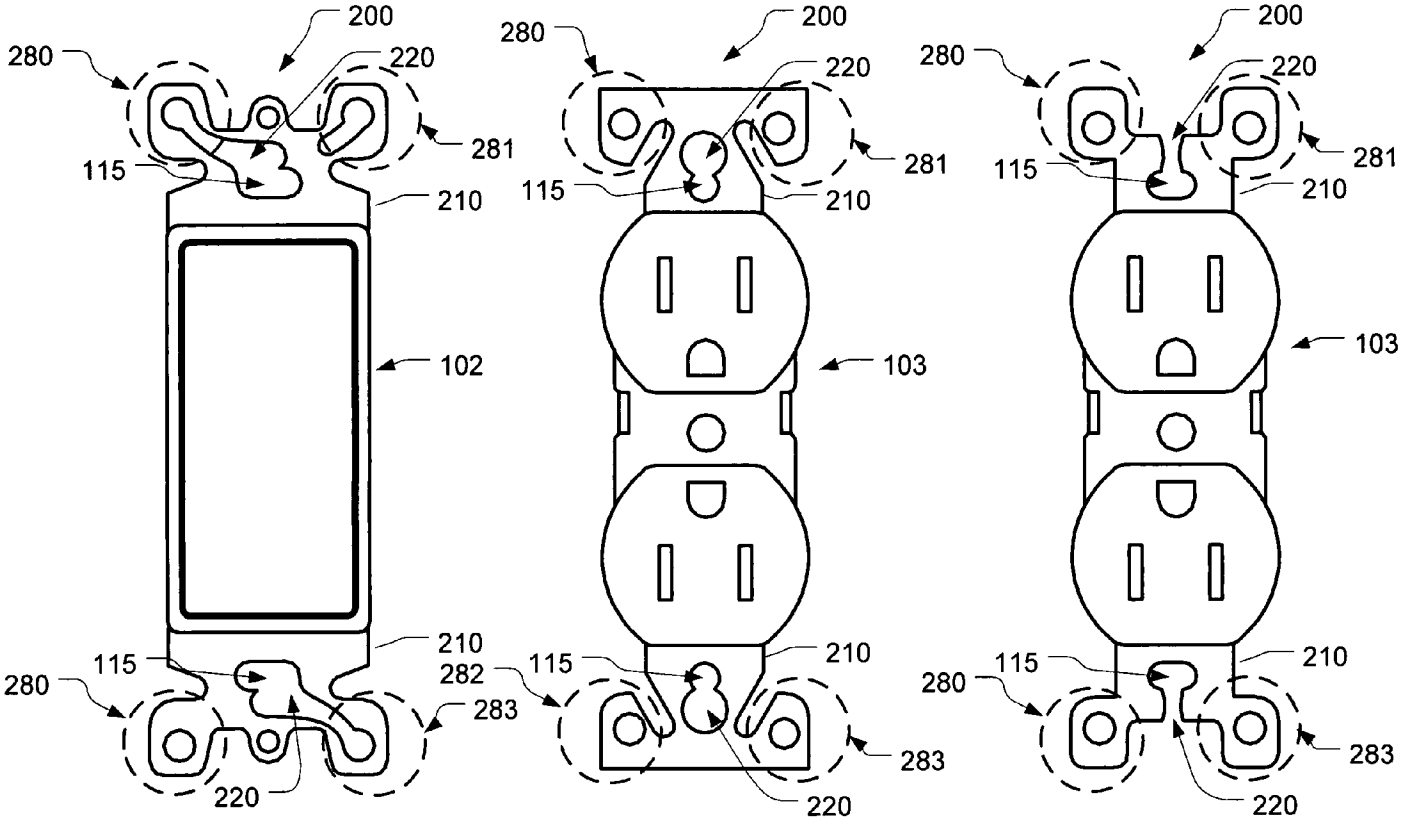
FIG. 2B is a diagram illustrating a further embodiment of an electrical device 210.
FIG. 2C is a diagram illustrating a further embodiment of an electrical device 210.
FIG. 2D is a diagram illustrating a further embodiment of an electrical device 200 wherein channel 220 extends from an outer edge of the yoke 210 into the slotted mounting hole 115.

FIG. 2B and FIG. 2C are diagrams illustrating a further embodiment of an electrical device 200. In this example, the electrical device 200 is configured as a switch 102, wherein channel 220 is configured as an enclosed opening positioned adjacent to and opening into the slotted mounting hole 115. In FIG. 2B the enclosed opening is generally elongated in shape. In FIG. 2C the enclosed opening is generally circular in shape. The enclosed opening will preferably be large enough to receive the head 253 and/or the support rim 258 of a mounting screw 250. The slotted mounting hole 115 will be wide enough to receive the diameter of the elongated post 252. Ears 280 and 281 extend from one end of the yoke 210, while ears 282 and 283 extend from the yoke at the end opposite ears 280 and 281.

FIG. 2D is a diagram illustrating a further embodiment of an electrical device 210 wherein channel 220 extends from an outer edge of the yoke 210 into the slotted mounting hole 115. The walls of the channel 220 are substantially parallel to each other. Ears 280 and 281 extend from one end of the yoke 210, while ears 282 and 283 extend from the yoke at the end opposite ears 280 and 281.

Figure 2G:
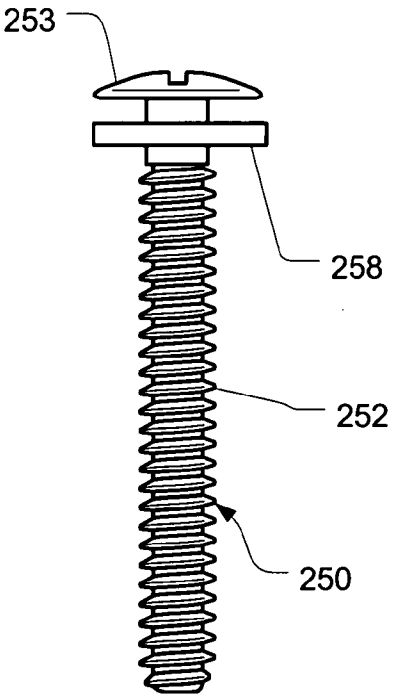
FIG. 2E, FIG. 2F and FIG. 2G are diagram illustrating embodiments of mounting screw 250.
Figure 2F:
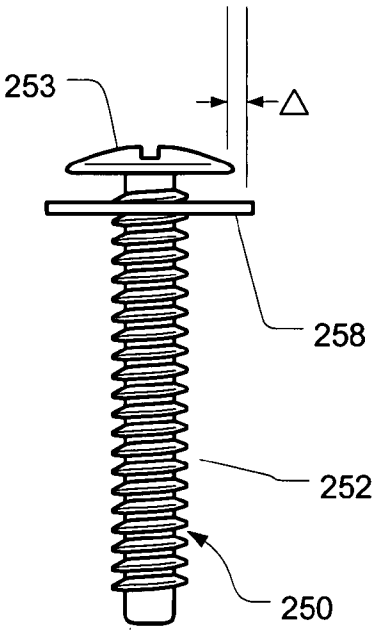
Figure 2E:
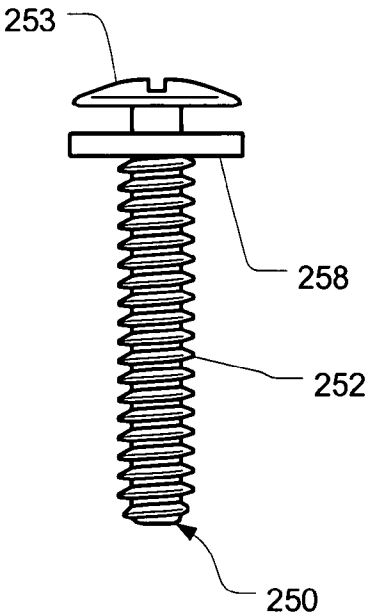

FIG. 2E, FIG. 2F and FIG. 2G are diagram illustrating embodiments of mounting screw 250. The mounting screw 250 includes an elongated threaded post 252, a head 253 and a support rim 258. The head 253 is located at one end of the elongated post 252. The support rim 258 is located at a predetermined point along the elongated post 252. In a preferred embodiment, the support rim 258 lies in a plane that is substantially parallel to the plane in which the head 253 lies. Additionally, the support rim 258 is preferably positioned along the elongated post 252 so as to provide a predetermined space between the head 253 and the support rim 258. In the embodiments shown in FIG. 2E and FIG. 2G the support rim 258 and the head 253 are substantially equal in size. In these examples, the diameter of support rim 258 and the head 253 are substantially the same. With reference to FIG. 2F it can be seen that the head 253 and the support rim 258 can be of different sizes. In this example, the diameter of the support rim 258 is larger than the diameter of head 253. The portion of the elongated post 252 located between the head 253 and the support rim 258 may be threaded or non-threaded. Further, the support rim 258 may be integrally formed as a part of the mounting screw 250 or, alternatively, it may be a separate member that may be securely placed on the mounting screw 250 so as to be held into place along the elongated post at a predetermined position relative to the head 253. In a further alternative embodiment, support rim 258 may be configured as a threaded nut, bolt or washer that is threaded onto the elongated post 252 up to a desired position on the elongated post 252.

Figure 3:
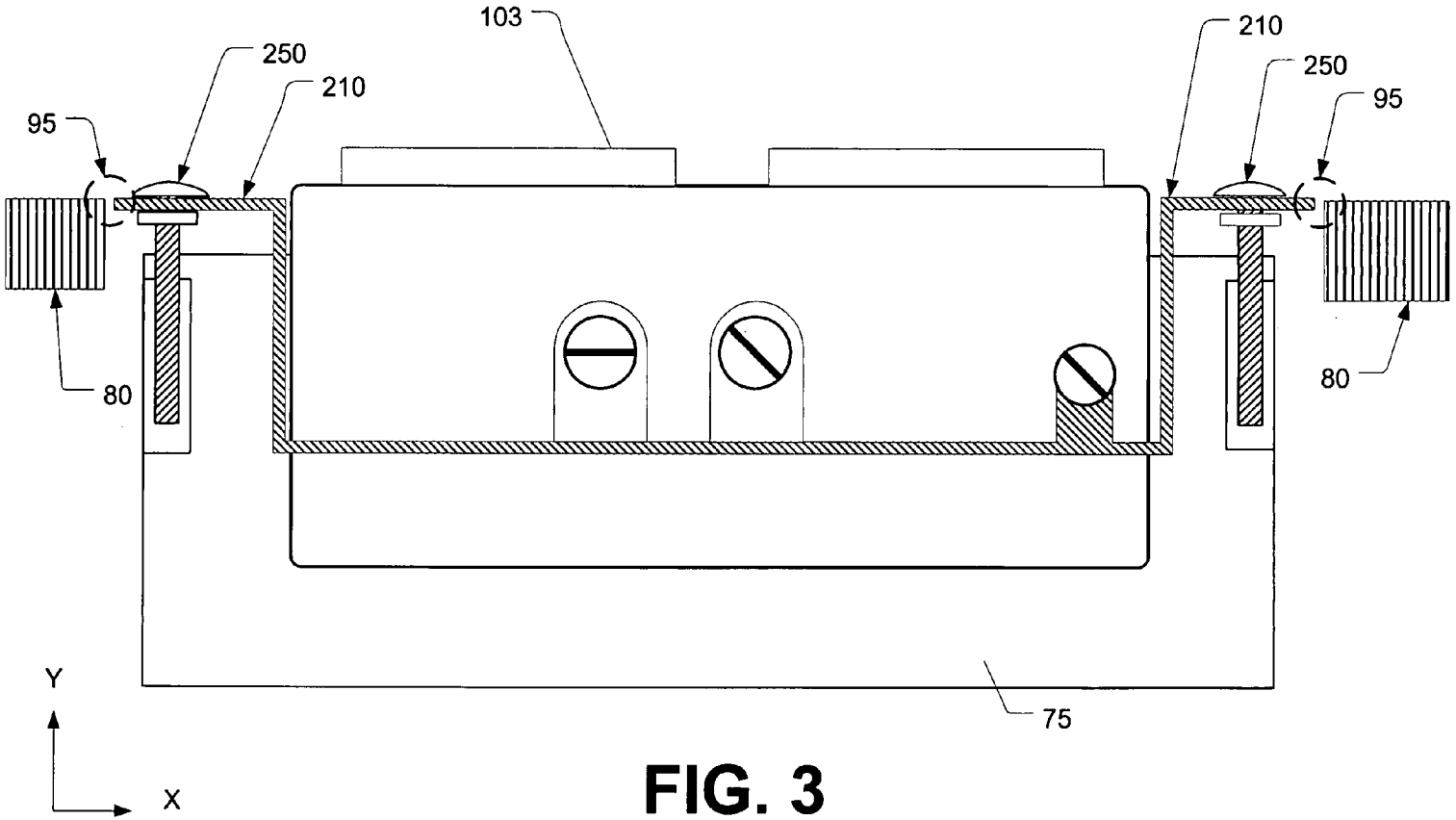
FIG. 3 is a diagram illustrating an electrical device 200 according to the invention that is installed in an outlet box 75.

FIG. 3 is a diagram illustrating an electrical device 200 according to the invention that is installed in an outlet box 75. In this illustration it can be seen that the electrical device 200 is mounted to the outlet box 75 via mounting screws 250. The mounting screws 250 are each threaded into the outlet box 75 as desired. The support rim 258 acts to limit the ability of yoke 210 to be moved in the Y direction (inward) toward the outlet box 72. In this case, the mounting screws 250 have been positioned so that the support rims 253 act to put the yoke 210 on a plane that is generally level with the plane in which the wall surface 80 is located. It can be seen that the hole in the wall surface 80 puts the wall surface too far away from the outlet box/electrical device 200 to provide any support for the yoke 250/electrical device 200.

Figure 4B:
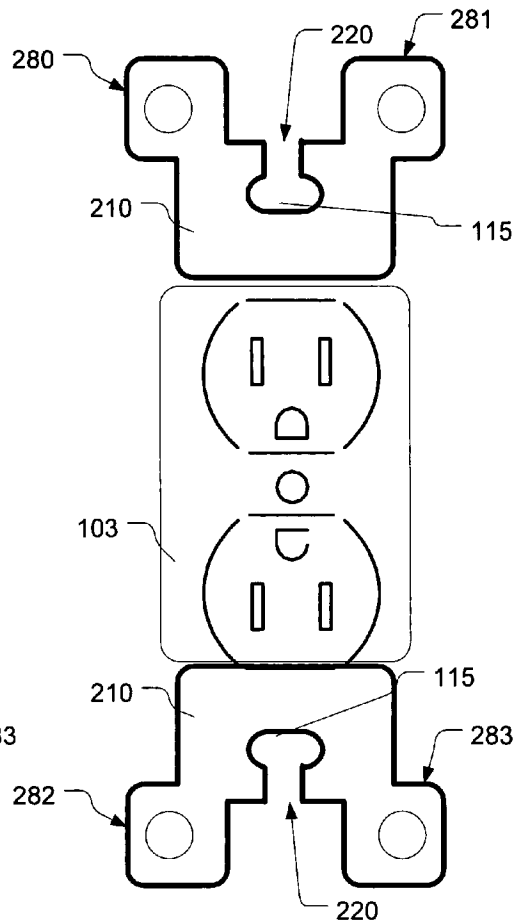
FIG. 4A and FIG. 4B are diagrams showing representations of embodiments of an electrical device in which the channel 220 extends from an outer edge of the device inward to the slotted mounting hole 115.
Figure 4A:
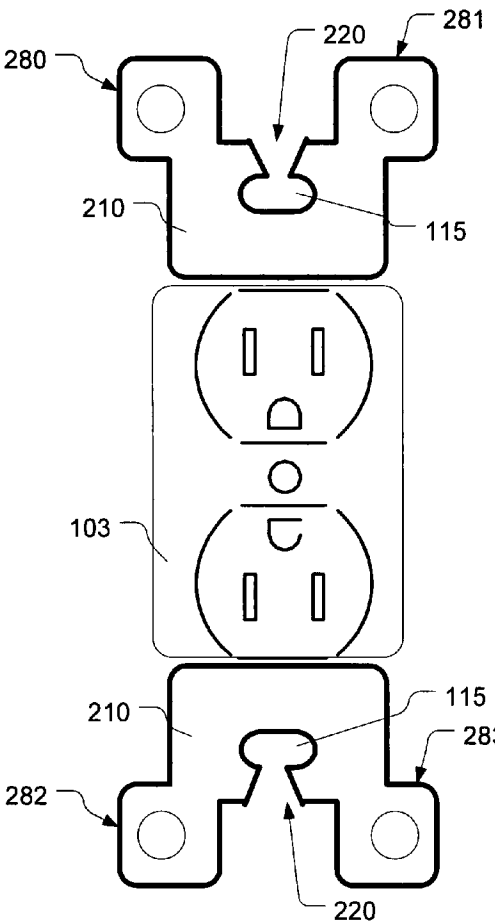
Figures 4C, 4D, 4E:
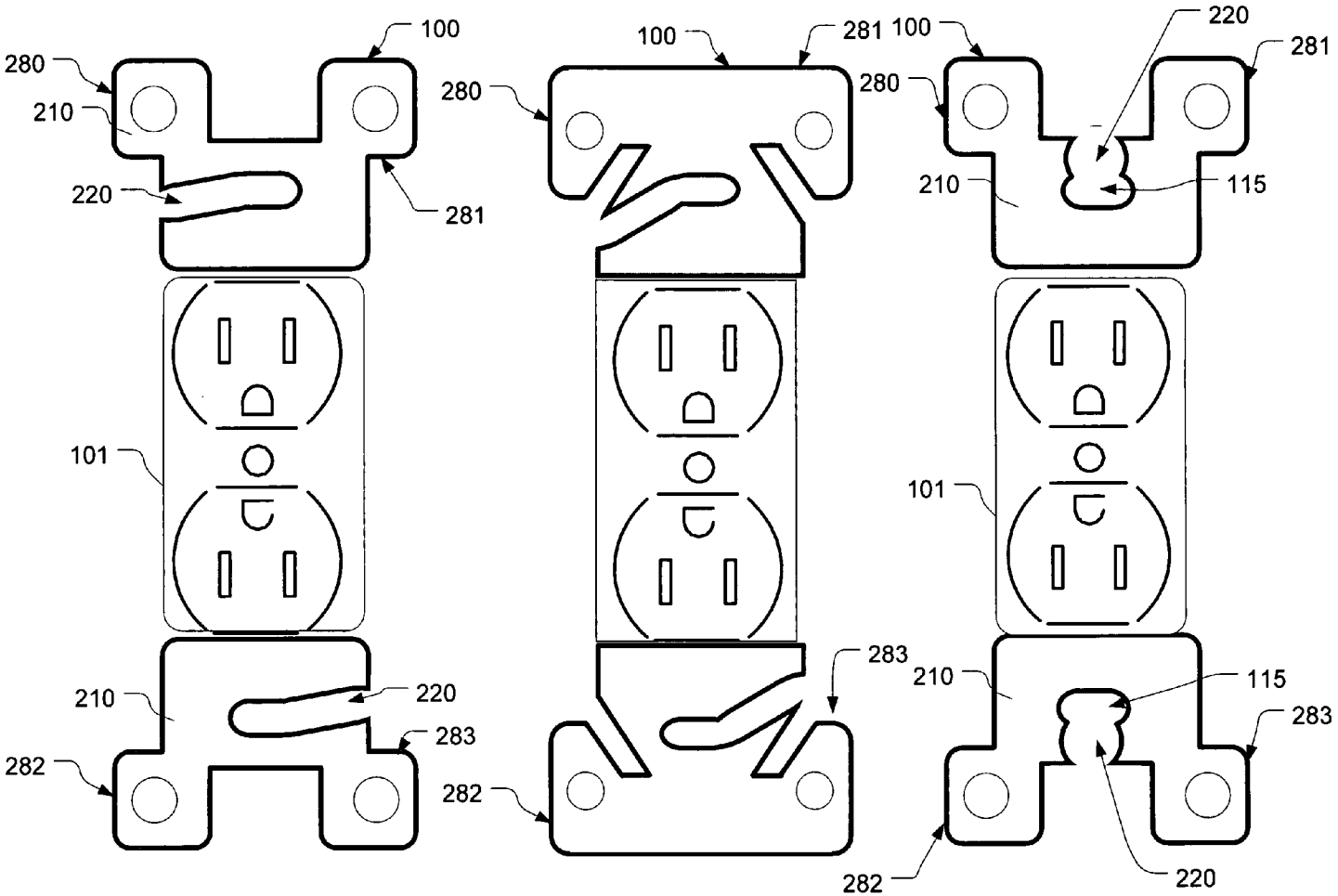
FIG. 4C, FIG. 4D and FIG. 4E are diagrams showing further representations of embodiments of an electrical device in which the channel 220 extends from an outer edge of the device inward to the slotted mounting hole 115.

FIG. 4A–FIG. 4E are diagrams illustrating further embodiments of an electrical device 200 wherein channel 220 extends from an outer edge of the yoke 210 into the slotted mounting hole 115. In FIG. 4A the walls of the channel 220 converge inward toward the slotted mounting hole 115. In FIG. 4B the walls of channel 220 are substantially parallel to each other. In FIG. 4C and FIG. 4D the channel 220 is configured to open from the long edge of the electrical device 200. In FIG. 4E channel 220 is substantially circular in shape and opens into the slotted mounting hole 115.

Figures 4F, 4G, 4H, 4I:
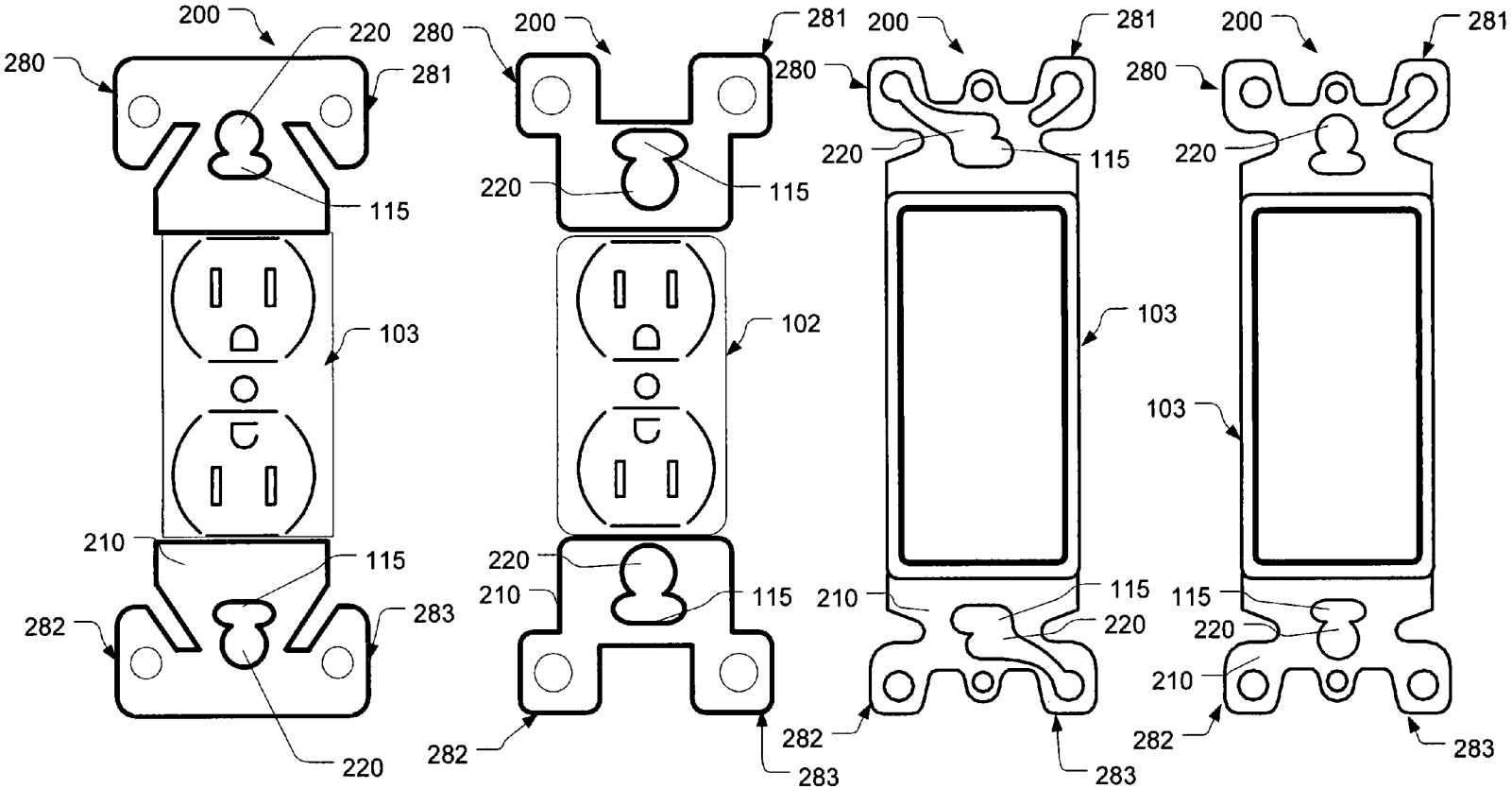
FIG. 4F, FIG. 4G, FIG. 4H and FIG. 4I are diagrams showing representations of embodiments of an electrical device in which the channel 220 is an enclosed opening positioned adjacent to and opening into the slotted mounting hole 115.

In FIG. 4F and FIG. 4I, the channel 220 is configured as a substantially enclosed opening positioned adjacent to and opening into the slotted mounting hole 115. In FIG. 4F, FIG. 4G and FIG. 4I the enclosed opening is generally circular in shape. In FIG. 4H the enclosed opening is generally elongated in shape. The enclosed opening will preferably be large enough to receive the head 253 of a mounting screw 250 (FIG. 2E–FIG. 2G). The slotted mounting hole 115 will be wide enough to receive the diameter of the elongated post 252.

Figure 5B:
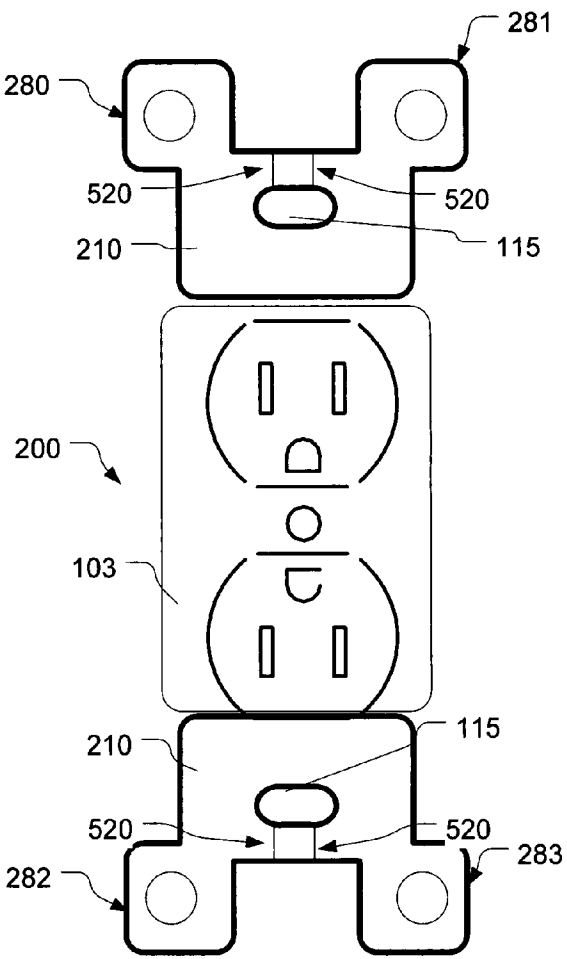
FIG. 5A and FIG. 5B are diagrams showing representations of embodiments of an electrical device 500 wherein score lines 520 are provided to allow a user to create a channel by removing material along the predetermined score lines 520.
Figure 5A:
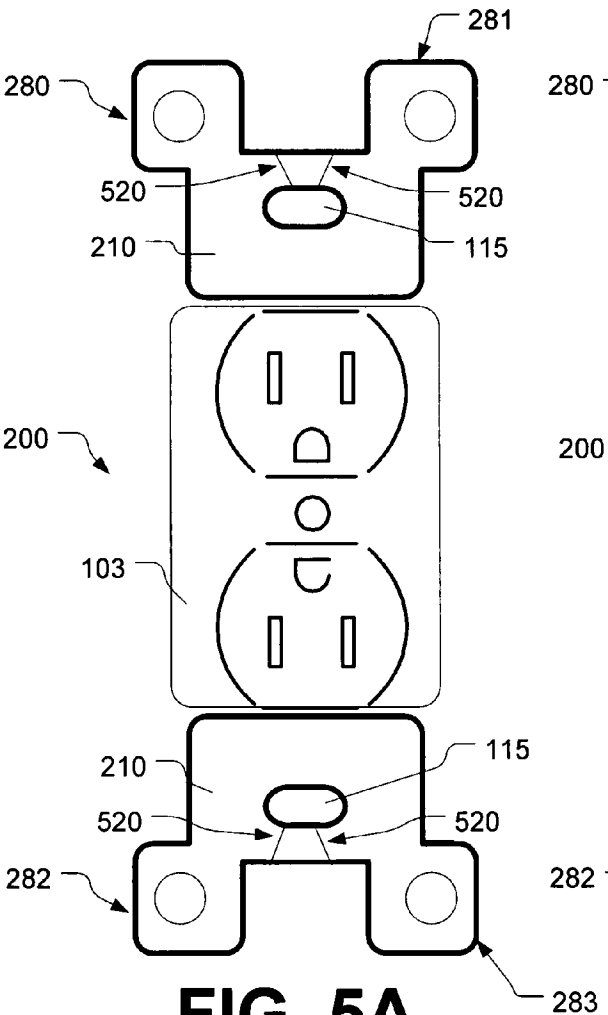

In a further embodiment of the invention, an electrical device 200 may be provided that includes score lines that define a portion of the yoke 210 that may be removed in order to create a channel 220. In FIG. 5A and FIG. 5B it can be seen that electrical device 200 is configured to include score lines 520 (channel score lines). These score lines delineate a portion of the yoke 210 that may be removed to form a channel 220 (FIG. 4A and FIG. 4B). The score lines 520 are preferably formed in the yoke 210 in a manner that will make it easier for the delineated portion (tab or plug) of the yoke 210 to be easily removed and thereby form a channel 220 (FIG. 4A and FIG. 4B). While these examples relate directly to the embodiments of the invention previously discussed with respect to FIG. 4A and FIG. 4B, it will be recognized that such score lines may be provided to delineate any configuration of a channel 220.

It should be emphasized that the above-described embodiments of the present invention, particularly, any "preferred" embodiments, are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of the present invention and protected by the following claims.

The invention claimed is:

1. An electrical device comprising a mounting yoke for mounting said electrical device into an outlet box wherein said yoke comprises:

a first slotted mounting hole for receiving a first mounting screw comprising a first support rim;

a second slotted mounting hole for receiving a second mounting screw comprising a second support rim;

first ear that extends from a first end of said yoke;

second ear that extends from a second end of said yoke;

a first channel leading into said first slotted mounting hole through which said first mounting screw may be passed into said first mounting hole; and a second channel leading into said second slotted mounting hole through which said second mounting screw may be passed into said second slotted mounting hole;

the width of said first channel is less than the maximum width of said first support rim; and the width of said second channel is less than the maximum width of said second support rim; and said yoke is configured so that the surface of the yoke surrounding the perimeter of said first slotted mounting hole lies in substantially the same plane.

2. The electrical device of claim 1 wherein said first mounting screw further comprises an elongated post, a head positioned at one end of the elongated post and said first support rim is positioned along the elongated post at a predetermined distance from said head and in a plane that is substantially parallel to the plane in which said head lies; and wherein said second mounting screw comprises an elongated post, a head positioned at one end of the elongated post and said second support rim positioned along the elongated post at a predetermined distance from said head and in a plane that is substantially parallel to the plane in which said head lies.

3. The electrical device of claim 1 wherein said first channel is positioned so as to open into said first slotted mounting hole; and wherein said second channel is positioned so as to open into said second slotted mounting hole.

4. The electrical device of claim 1 wherein said electrical device comprises a receptacle.

5. The electrical device of claim 1 wherein said electrical device comprises a switch.

6. An electrical device comprising a mounting yoke for mounting said electrical device into an outlet box wherein said yoke comprises:

a first mounting hole for receiving a first mounting screw comprising a first support rim;

a second mounting hole for receiving a second mounting screw comprising a second support rim;

first ear that extends from a first end of said yoke;

second ear that extends from a second end of said yoke;

a first channel extending from an outer edge of said yoke and leading into said first mounting hole and through which said first mounting screw may be passed into said first mounting hole;

a second channel extending from an outer edge of said yoke and leading into said second mounting hole and through which said second mounting screw may be passed into said second mounting hole;

a width of said first channel is less than the maximum width of said first support rim;

a width of said second channel is less than the maximum width of said second support rim; and said yoke is configured so that the surface of the yoke surrounding the perimeter of said first mounting hole lies in substantially the same plane.

7. The electrical device of claim 6 wherein said first channel comprises two walls that are substantially parallel to each other; and wherein said second channel comprises two walls that are substantially parallel to each other.

8. The electrical device of claim 6 wherein said first channel comprises two walls that converge inward from an outer edge of said mounting yoke into said first slotted mounting hole; and wherein said second channel comprises two walls that converge inward from an outer edge of said mounting yoke into said second slotted mounting hole.

9. The electrical device of claim 6 wherein said first channel comprises a substantially enclosed opening; and wherein said second channel comprises a substantially enclosed opening.

10. The electrical device of claim 9 wherein said first channel and said second channel is are generally circular in shape.

11. The electrical device of claim 10 wherein said first channel is configured so as to be large enough to accommodate the head of said first mounting screw; and wherein said second channel is configured so as to be large enough to accommodate the head of said second mounting screw.

12. An electrical device comprising:

a mounting yoke for mounting said electrical device into an outlet box;

said mounting yoke comprises:

first ear that extends from a first end of said yoke;

second ear that extends from a second end of said yoke;

first mounting hole for receiving a first mounting screw;

second mounting hole for receiving a second mounting screw;

first score line delineating a portion of the yoke that can be removed to form a first channel that extends from an outer edge of said yoke and opens into said first mounting hole;

second score line delineating a portion of the yoke that can be removed to form a second channel that extends from an outer edge of said yoke and opens into said second mounting hole;

when said first portion is removed, said first channel is configured to receive a mounting screw and allow it to be passed into said first slotted mounting hole; and when said second portion is removed, said second channel is configured to receive a mounting screw and allow it to be passed into said second mounting hole.

13. The electrical device of claim 12 further comprising an electrical receptacle.

14. The electrical device of claim 12 further comprising an electrical switch.

15. An electrical device comprising:

mounting yoke for mounting said electrical device into an outlet box;

mounting screw for mounting said device into an outlet box;

said mounting screw comprises:

elongated post connected at one end to a head;

support rim positioned at a predetermined point along said elongated post and in a plane substantially parallel to the plane in which said head lies;

said mounting yoke comprises:

a first mounting hole for receiving a first mounting screw comprising a first support rim;

a second mounting hole for receiving a second mounting screw comprising a second support rim;

first ear that extends from a first end of said yoke;

second ear that extends from a second end of said yoke;

channel configured to open into said slotted mounting hole to allow a mounting screw to be passed into said slotted mounting hole, a first channel extending from an outer edge of said yoke and leading into said first mounting hole and through which said first mounting screw may be passed into said first mounting hole;

a second channel extending from an outer edge of said yoke and leading into said second mounting hole and through which said second mounting screw may be passed into said second mounting hole;

a width of said first channel is less than the maximum width of said first support rim;

a width of said second channel is less than the maximum width of said second support rim; and said yoke is configured so that the surface of the yoke surrounding the perimeter of said first mounting hole lies in substantially the same plane.

16. The electrical device of claim 15 further comprising an electrical switch.

* * * * *